US011067356B2

(12) United States Patent
Haas

(10) Patent No.: US 11,067,356 B2
(45) Date of Patent: Jul. 20, 2021

(54) BOWSTRING RELEASE

(71) Applicant: FERADYNE OUTDOORS, LLC, Superior, WI (US)

(72) Inventor: Matthew Peter Haas, Duluth, MN (US)

(73) Assignee: FERADYNE OUTDOORS, LLC, Superior, WI (US)

( * ) Notice: Subject to any disclaimer, the term of this patent is extended or adjusted under 35 U.S.C. 154(b) by 0 days.

(21) Appl. No.: 16/343,491

(22) PCT Filed: Oct. 18, 2017

(86) PCT No.: PCT/US2017/057105
§ 371 (c)(1),
(2) Date: Apr. 19, 2019

(87) PCT Pub. No.: WO2018/075590
PCT Pub. Date: Apr. 26, 2018

(65) Prior Publication Data

US 2019/0265000 A1 Aug. 29, 2019

Related U.S. Application Data

(60) Provisional application No. 62/411,108, filed on Oct. 21, 2016.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| 5,694,915 | A | 12/1997 | Summers | |
| 6,571,786 | B2 | 6/2003 | Summers et al. | |
| 6,584,966 | B1 | 7/2003 | Summers et al. | |
| 6,631,709 | B2 * | 10/2003 | Carter | F41B 5/1469 124/35.2 |
| 6,647,976 | B2 | 11/2003 | Summers et al. | |
| 6,763,819 | B2 | 7/2004 | Eckert | |

(Continued)

FOREIGN PATENT DOCUMENTS

KR 10-1551624 B1 9/2015

OTHER PUBLICATIONS

International Search Report for corresponding International Application No. PCT/US2017/057105 dated Dec. 27, 2017; 3 pages.

(Continued)

*Primary Examiner* — John A Ricci
(74) *Attorney, Agent, or Firm* — Greenberg Traurig, LLP; Dipak J. Shah

(57) ABSTRACT

A bowstring release having a handle, a jaw, and a sear. The jaw is configured for drawing and releasing the bowstring. The sear includes a plurality of settings for adjusting the rotation of the handle at which the jaw releases the bowstring. While the bowstring is in the drawn configuration, the jaw and the sear are slidingly coupled and the jaw slides along a surface of the sear while the release is rotated. The bowstring is released when the jaw and the sear de-couple.

28 Claims, 12 Drawing Sheets

(56) References Cited

U.S. PATENT DOCUMENTS

| | | | | |
|---|---|---|---|---|
| 6,895,951 | B2 | 5/2005 | Summers et al. | |
| 6,945,241 | B2 | 9/2005 | Pellerite | |
| 6,953,035 | B1 | 10/2005 | Summers et al. | |
| 7,240,672 | B2 | 7/2007 | Peck et al. | |
| 7,314,045 | B2 | 1/2008 | Eckert et al. | |
| 8,276,575 | B1 | 10/2012 | Gillig | |
| 8,869,781 | B2 * | 10/2014 | Jones | F41B 5/1469 124/35.2 |
| 8,997,729 | B1 | 4/2015 | Gillig | |
| 9,027,540 | B2 * | 5/2015 | Springer | F41B 5/1469 124/31 |
| 9,250,032 | B2 | 2/2016 | Kelly et al. | |
| 2011/0168146 | A1 | 7/2011 | Deceuster | |
| 2012/0285431 | A1 | 11/2012 | Summers et al. | |
| 2016/0231077 | A1 | 8/2016 | Kelly | |
| 2016/0258708 | A1 | 9/2016 | Syverson et al. | |
| 2017/0176129 | A1 | 6/2017 | Haas et al. | |

OTHER PUBLICATIONS

Written Opinion for corresponding International Application No. PCT/US2017/057105 dated Dec. 27, 2017; 9 pages.

* cited by examiner

BOWSTRING RELEASE

CROSS-REFERENCE TO RELATED APPLICATIONS

This application is a National Stage application under 35 U.S.C. 371 ("371 Application") of International Patent Application No. PCT/US2017/057105 filed Oct. 18, 2017, which claims the benefit of U.S. Provisional Patent Application No. 62/411,108 filed Oct. 21, 2016, the entirety of which applications are herein incorporated by reference.

STATEMENT REGARDING FEDERALLY SPONSORED RESEARCH OR DEVELOPMENT

Not applicable.

TECHNICAL FIELD

The instant disclosure relates to a bowstring release.

BACKGROUND

U.S. Pat. No. 6,763,819 discloses a bow string release for engaging and releasing a bow string, comprising opposing jaws, a trigger, a housing, a jaw roller and a plurality of pins. The opposing jaws and the trigger are coupled to the housing by pins, and the jaw roller, coupled to the trigger, allows the opposing jaws to an open condition when the trigger is in a pulled position. The bow string release is adapted to minimize "loading up" of trigger force required to pull the trigger at full draw of a bow. Further the bow string release is adapted to release the bow string at a trigger pull force of equal to or less than 9 ounces when an effective draw weight of the bow is equal to or more than 15 pounds.

U.S. Pat. No. 7,240,672 discloses an adjustable trigger pressure archery release including a bayonet mounted trigger utilizing an actuator ramp to reduce trigger travel. The caliper jaws and cam profile combine to create an automatic closing action to close the release, whereby rearward pulling or squeezing movement of the trigger engages the caliper jaws to an open bow string or string loop apparatus receiving condition, and relaxing or releasing movement of the trigger closes the caliper jaws into a string retaining position. The release includes an independent mechanism for permitting adjustment of the trigger pressure force, without affecting trigger travel including frictional means of maintaining selected setting. The release head is universally adjustable or lockable relative to a wrist strap or similar mounting.

U.S. Pat. No. 7,314,045 discloses a string release for providing accurate release of a tensioned bow string. The release has a pair of jaws which are retained and controlled by a pivot ball and a jaw cup. The pivot ball is mounted on a shaft which is attached to an inner race which is in turn contained within a ball housing. The inner race is positioned such that it may slide laterally within the ball housing. In the closed position, a number of balls retain the inner race in an aft position relative to the jaws. A trigger mechanism actuates a locking sleeve which allows the balls to move such that the inner race may slide forward, thereby allowing the jaw to open. The release further includes a trigger force adjusting mechanism that allows adjustment of the force required to activate the trigger mechanism.

U.S. Pat. No. 8,276,575 discloses an archery bowstring release having a pair of bowstring-gripping jaws actuatable by a trigger, with the trigger and jaws both being pivotally linked to the housing. A cam situated within the housing has a trigger cam pivot which translates and rotates with respect to the trigger, such that the cam is urged by actuation of the trigger to open and close the jaws. The forward part of the housing bearing the jaws may be rotatable with respect to the rear part of the housing, such that the plane in which the jaws move can be rotated with respect to the plane in which the trigger moves.

U.S. Pat. No. 8,997,729 discloses an archery bowstring release having a single jaw for retaining a bowstring within a bowstring hook, in contrast to dual jaw pincer-type releases. The bowstring hook is situated on a release head which bears a trigger for actuating the jaw and releasing the bowstring, and a release body extends between the release head and a release mount (which can connect the bowstring release to a wrist strap, glove, or other anchor affixed to the user's body). The release head and body are pivotally joined, and when the release is ready to fire, the central axis of the release body, and at least the rear of the release head, have central longitudinal axes which are aligned with the notch in the bowstring hook, and are thus aligned with the bowstring, and are parallel to or in line with the arrow. The release therefore has a comfortable, natural, and intuitive feel during operation.

U.S. Patent Application Publication No. 2016/0258708 discloses systems and methods that enable archers to select and interchange various styles of interchangeable triggers, including one-finger and two-finger triggers, for use in an archery release. The interchangeable triggers enable an archer to customize the archery release with regard to increasing the archer's comfort and improving the archer's shooting performance.

U.S. Patent Application Publication No. 2017/0176129 discloses an archery release configured to eliminate, or at least minimize, vibrations and/or noise generated when a drawn bowstring is released from a pre-shoot position. The archery release includes a substrate subassembly and an overmolding material bonded to each other. The overmolding material is configured to absorb and eliminate, or at least minimize the vibrations and/or noise. The archery release also includes a trigger, a release mechanism, and a latching assembly extending into a hollow interior of a handle of the archery release. Within the handle, the latching assembly is operably coupled with the trigger and with the release mechanism. Vibrations and/or noise is eliminated, or at least minimized, by placing the overmolding material at locations whereat one or more components of the trigger, the latching assembly, and the release mechanism strike or engage the overmolding material instead of the substrate subassembly.

As can be seen, several prior art bowstring releases include a trigger for releasing the bowstring from a drawn configuration. However, bowstring release anticipation or anxiety is a concern which has been left unresolved.

SUMMARY

A non-limiting exemplary embodiment of a bowstring release includes a handle, a jaw, and a sear. The jaw is configured for drawing and releasing the bowstring. The sear includes a plurality of settings for adjusting the rotation of the handle at which the jaw releases the bowstring. While the bowstring is in the drawn configuration, the jaw and the sear are slidingly coupled and the jaw slides along a surface of the sear while the release is rotated. The bowstring is released when the jaw and the sear de-couple.

In some embodiments, the release emits a signal before the bowstring is released. In certain embodiments, each of the plurality of settings corresponds to an amount the release rotates after the signal is emitted and before the bowstring is released. In some embodiments, the release emits one or more signals before the bowstring is released. In certain embodiments, the number of signals emitted corresponds to one of the plurality of settings.

DETAILED DESCRIPTION

One or more non-limiting embodiments are described herein with reference to the accompanying drawings, wherein like elements are designated by like numerals. It should be clearly understood that there is no intent, implied or otherwise, to limit the disclosure in any way, shape or form to the embodiments illustrated and described herein. While multiple exemplary embodiments may be illustrated and described, variations thereof will become apparent or obvious to a person of ordinary skill. Accordingly, any and all variants and/or equivalents of the one or more embodiments disclosed herein are considered as being within the metes and bounds of the instant disclosure.

Figure 1:
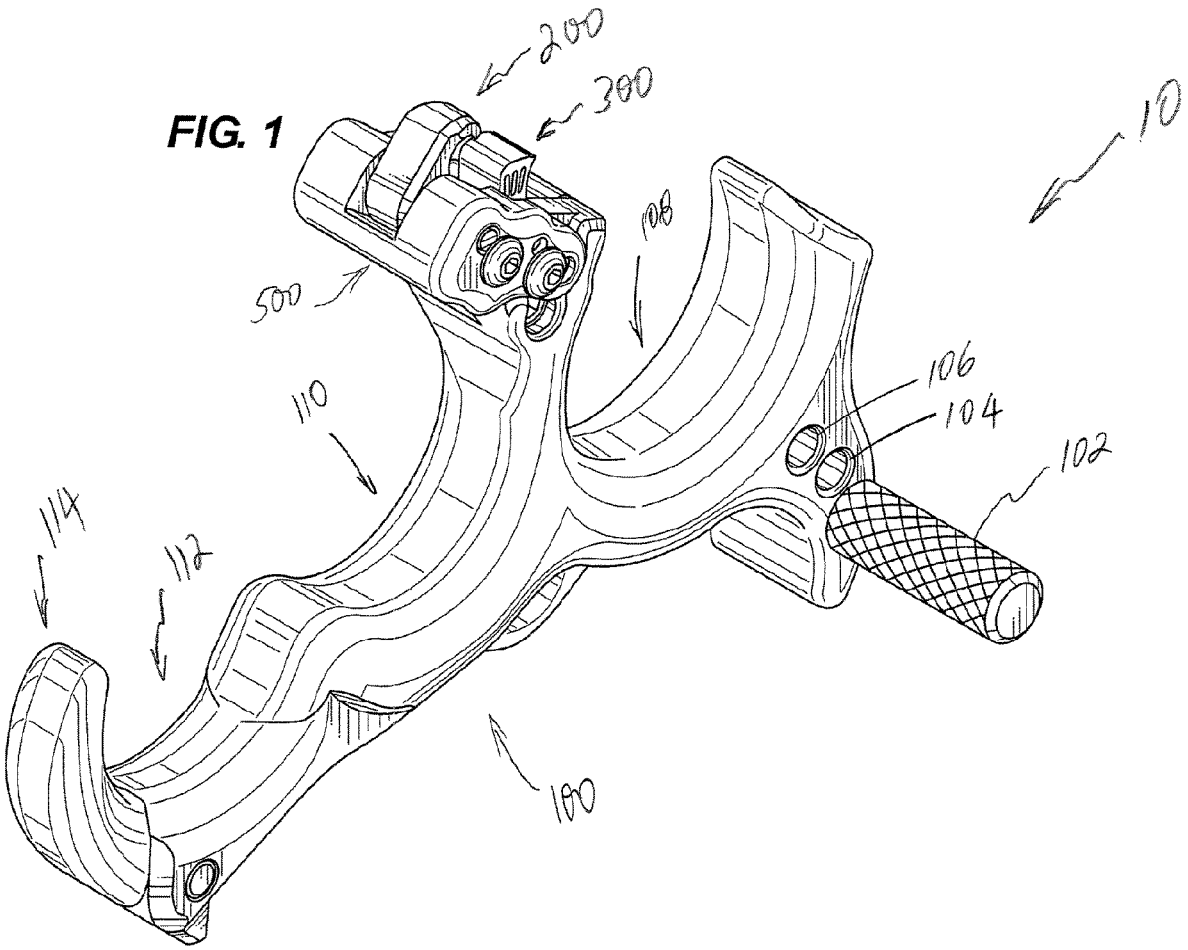
FIG. 1 is a perspective view of a non-limiting exemplary embodiment of a bowstring release of the instant disclosure.
Figure 2:
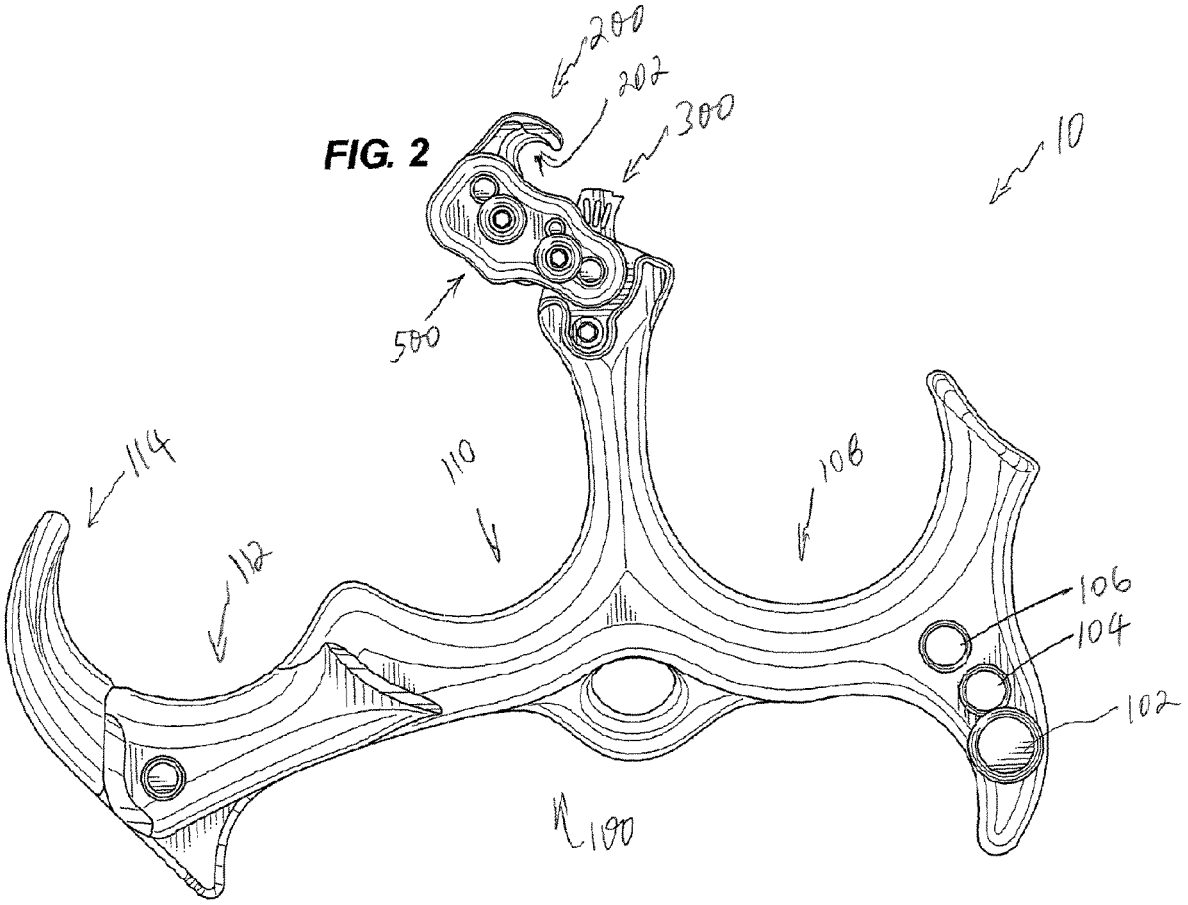
FIG. 2 is a side view of the bowstring release of FIG. 1.
Figure 3:
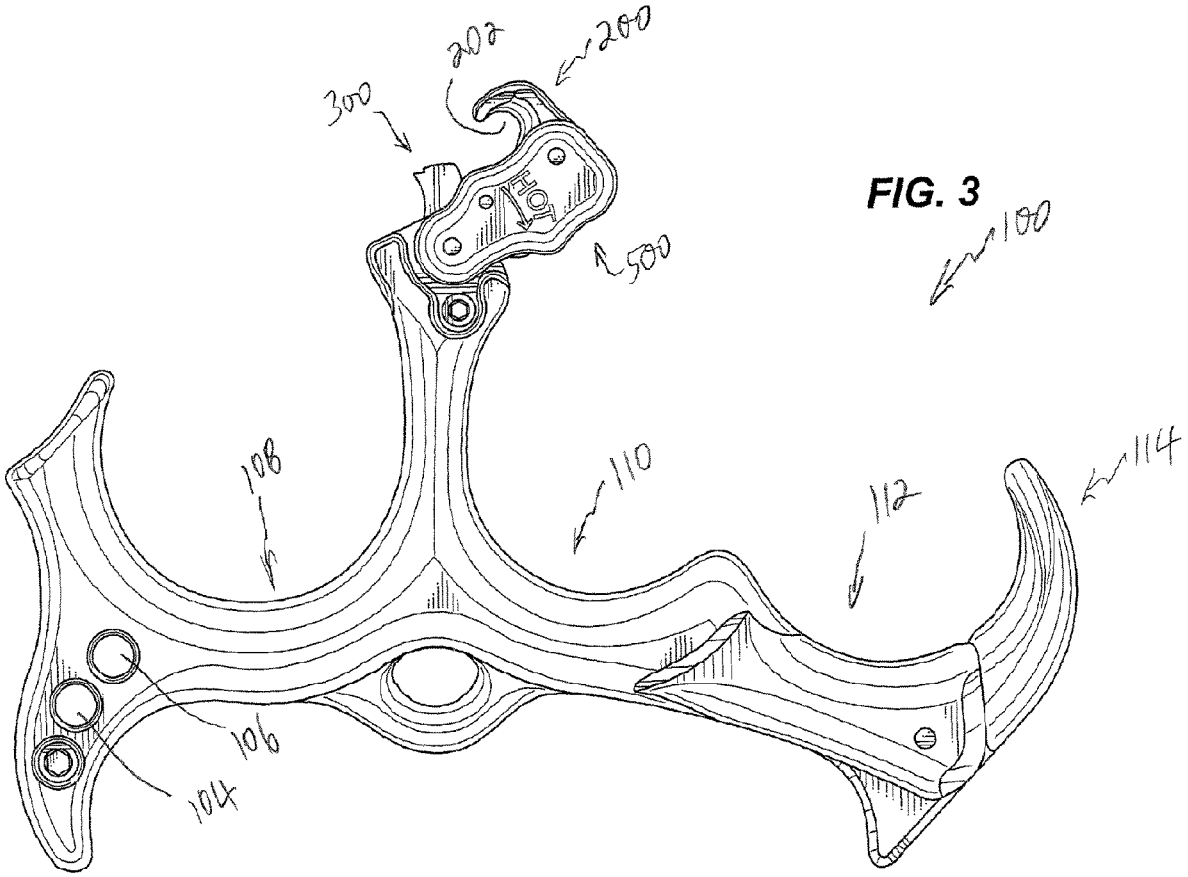
FIG. 3 is a side view of the bowstring release opposite the view illustrated in FIG. 2.
Figure 4:
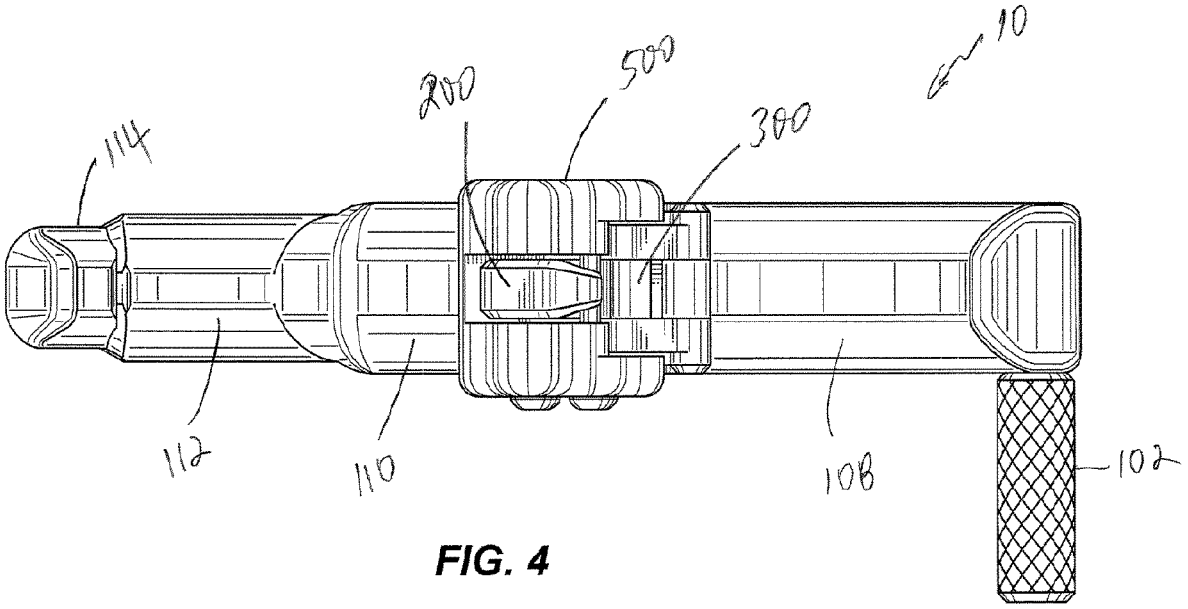
FIG. 4 is a front view of the bowstring release of FIG. 1.

FIGS. 1-4 illustrate a non-limiting exemplary embodiment of a bowstring release 10. FIG. 1 is a perspective view of the bowstring release 10; FIG. 2 is a side view of the bowstring release 10; FIG. 3 is another side view of the bowstring release 10 as viewed from the side opposite that illustrated in FIG. 2; and FIG. 4 is a front view of the bowstring release 10.

Generally, the release 10 is configured for drawing a bowstring and then releasing the drawn bowstring when the release is rotated a pre-determined or pre-set amount. The release 10 is configured to emit a signal before releasing the bowstring to notify the user that continued rotation of the release 10 will release the bowstring. The amount or extent to which the release must be rotated after emitting the signal and before releasing the drawn bowstring is adjustable.

In some embodiments, the bowstring release 10 includes a handle 100, a jaw 200 coupled to the handle 100, and a sear 300 coupled to the handle 100. In certain embodiments, the jaw 200 and the sear 300 are slidingly coupled while the release 10 draws or pulls on a bowstring (not shown) that is held or retained in a generally hook-shaped portion 202 of the jaw 200. While the jaw 200 and the sear 300 remain coupled with each other, the jaw 200 is inhibited from opening and releasing the bowstring. When the release 10, and more particularly the handle 100, is rotated with the bowstring drawn, at least a portion of the jaw 200, e.g., portion 204 (see FIGS. 8A-8B) slides along at least a portion of a surface of the sear 300. In some embodiments, the sear 300 includes a plurality of settings for adjusting the extent or the amount that the release 10 must be rotated for releasing the bowstring after the signal has been emitted. After emitting the signal, continued rotation of the release 10 by the amount dictated by the indication to which the sear 300 has been set, the jaw 200 slides off the surface of the sear 300 and decouples from the sear 300. Consequently, the jaw 200 "opens" and releases the bowstring. In some embodiments, the jaw 200 is spring-biased to retain the jaw 200 in a normally "open" state. In certain embodiments, the jaw 200 "opens" because of the force exerted by the drawn bowstring. In some embodiments, the combination of spring-biasing and the force exerted by the drawn bowstring cause the jaw 200 to "open".

Figure 5:
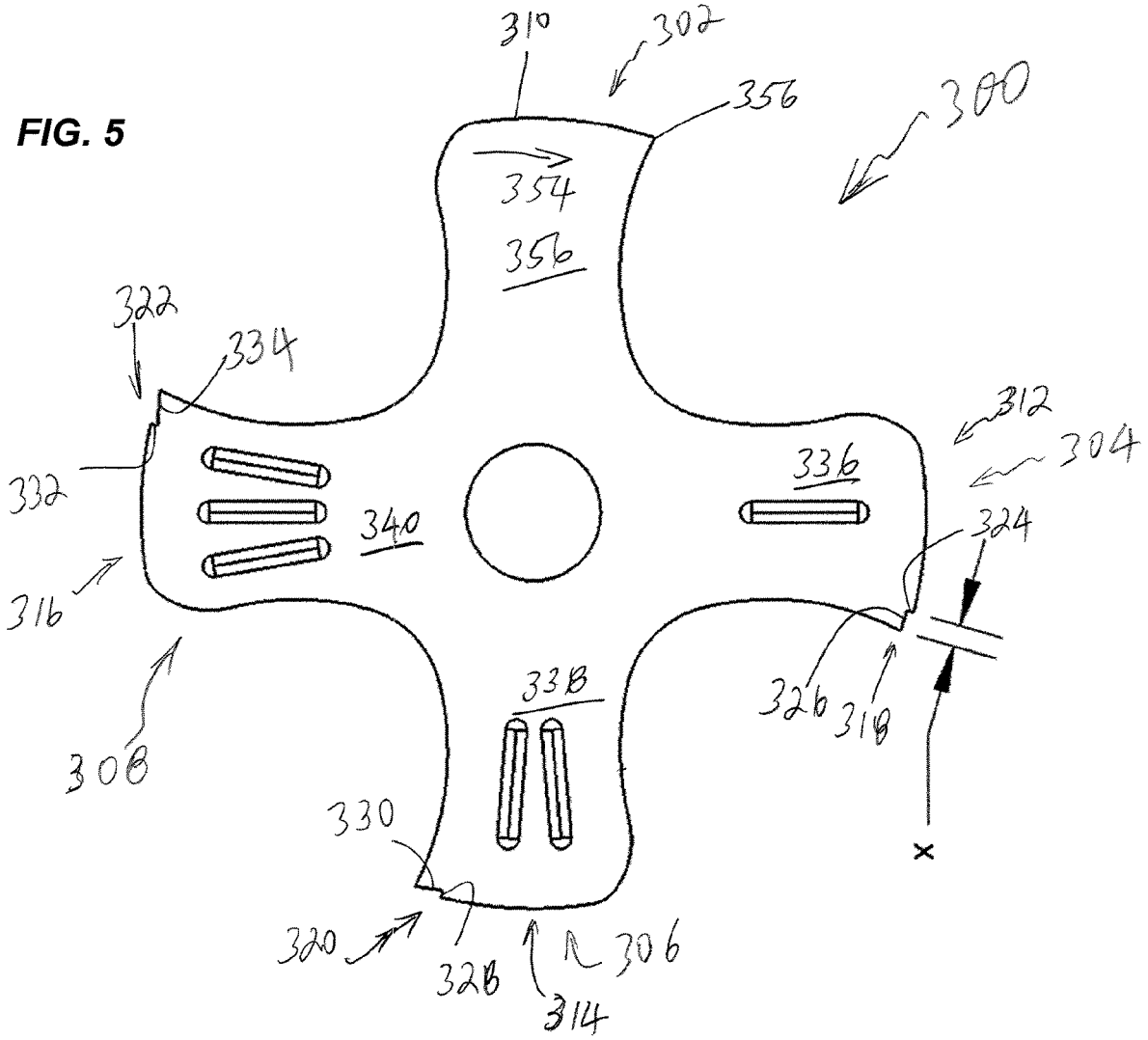
FIG. 5 is an elevational view of a non-limiting exemplary embodiment of a sear of the instant disclosure.

FIG. 5 illustrates a non-limiting exemplary embodiment of the sear 300 configured with four discrete settings that define the amount the release 10 must be rotated after emitting the signal for de-coupling the jaw 200 and the sear 300, and releasing the bowstring. It should be clearly understood that there is no intent, implied or otherwise, to limit the number of setting provided on a sear. Some embodiments of the sear 300 may have more than four discrete settings, while other embodiments of the sear 300 may have less than four discrete settings.

In some embodiments, such as the exemplary embodiment illustrated in FIG. 5, the sear 300 is configured with four lobes 302, 304, 306 and 308 that define four discrete settings for the amount the release 10 must be rotated to release the bowstring after the signal is emitted. The lobes 302, 304, 306 and 308, respectively, include a surface 310, 312, 314 and 316. Each surface 312, 314 and 316 of respective lobe 304, 306 and 308 includes a cut or a step 318, 320 and 322, respectively. Each step 318, 320 and 322 is defined by a height (e.g., riser height) and a length (or distance, e.g., tread run). For instance, step 318 is defined by height 324 and length 326; step 320 is defined by height 328 and length 330; and step 322 is defined by height 332 and length 334. In some embodiments of the sear 300, some or all heights 324, 328 and 332 may be equal to one another. In certain embodiments, some or all heights 324, 328 and 332 may be unequal from one another. In some embodiments of the sear 300, some or all lengths 326, 330 and 334 may be equal to one another. In certain embodiments, some or all lengths 326, 330 and 334 may be unequal from one another.

The relative distances of the lengths 326, 330 and 334 define the amount the release 10 is required to rotate after emitting the signal and before releasing the bowstring. This, the relative amount of rotation required for each lobe 304, 306 and 308 may be indicated by indentations, markings and such on respective surface 336, 338 and 340. Accordingly, in some embodiments of the sear 300, the surface 336 of the lobe 304 includes the indentation or marking "I"; the surface 338 of the lobe 306 includes the indentation or marking "I I"; and the surface 340 of the lobe 308 includes the indentation or marking "I I I". In certain embodiments, these indentations or markings "I", "I I" and "I I I" correspond to the lengths or distances 326, 330 and 334 of respective lobes 304, 306 and 308. In an embodiment of the sear 300, such as that illustrated in FIG. 5, the length 326 is less than the length 330 which in turn is less than the length 334. Accordingly, the user is made aware that if setting "I I" (i.e., lobe 306) is selected on the sear 300, then the amount that the release 10 must be rotated after the signal is emitted and before the bowstring is released will be more than the amount that would be required if setting "I" had been selected and less than the amount that would be required if the setting "I I I" had been selected.

Figure 6:
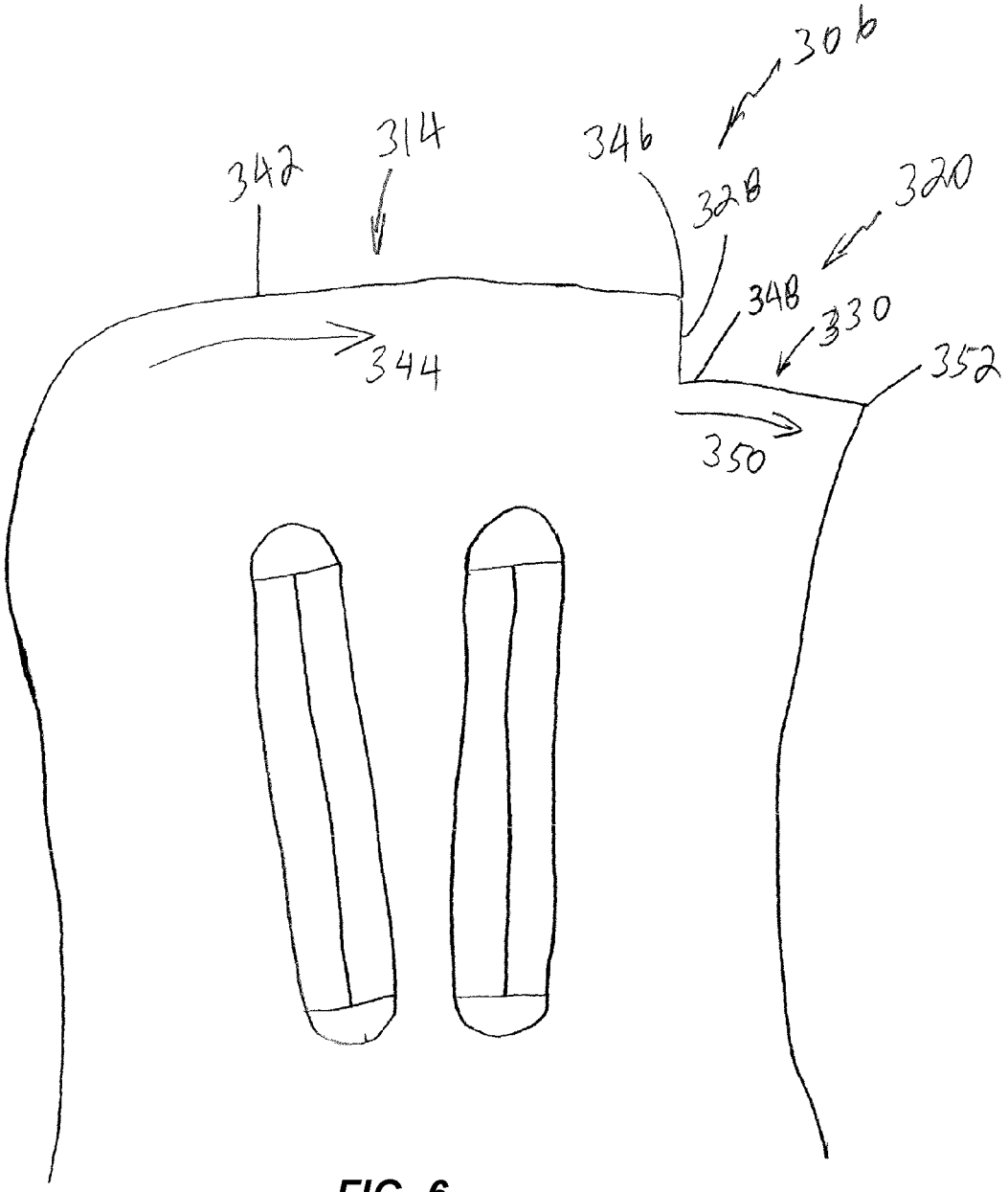
FIG. 6 is a detailed view of a portion of one of the lobes of the sear of FIG. 5.

Referring now to FIG. 6, when the release 10 draws on the bowstring with the setting "I I" selected on the sear 300, at least the portion 204 of the jaw 200 slidingly engages or couples with at least a portion of the surface 342 of the lobe 306. As the user rotates the release 10, the jaw 200 slides on the surface 342 in the direction indicated by the arrow 344 towards the step 320. As the jaw 200 approaches the step 320, i.e., the end 346 at the top of the step 320, continued rotation of the release 10 will cause the jaw 200 to slide off the surface 342 and "fall over" the end 346, i.e. "fall off" the step 320, impact and slidingly couple with at least a portion of the surface 348 of the lobe 306, and emit an audible signal. The audible signal emitted by the release 10 when the jaw 200 impacts at least a portion of the surface 348 informs the user that the bowstring will be released after the release 10 has rotated the amount defined by the length 330. As the user continues to rotate the release 10 after the signal has been emitted, the slidingly coupled portion 204 of the jaw 200 slides along at least a portion of the surface 348 in the direction indicated by the arrow 350 towards the end 352 of the surface 348. With continued rotation of the release 10, the jaw 200 will slide off the surface 348 at the end 352 and de-couple or dis-engage from the lobe 306. Concurrently, the jaw 200 will "open" and release the bowstring.

It will be appreciated that the operational interactions between the jaw 200 and the lobe 306 of the sear 300, as described in detail hereinabove with reference to FIG. 6, is also equally applicable for the interaction of the jaw 200 and the lobes 304 and 308 of the sear 300. Accordingly, repeating the description for the lobes 304 and 308, is considered redundant and therefore not necessary.

Now, with regards to lobe 302 of the sear 300, it should be noted that the surface 310 is contiguous and does not include a cut or a step. When the release 10 draws the bowstring, at least the portion 204 of the jaw 200 slidingly engages or couples with at least a portion of the surface 310. As the user continues to rotate the release 10, the jaw 200 will slide along the surface 310 in the direction indicated by the arrow 354 towards the end 356 of the surface 310. With continued rotation of the release 10, the jaw 200 will slide off the surface 310 at the end 352 and de-couple or dis-engage from the lobe 302. Consequently, the jaw 200 will "open" and the bowstring will be released. Since the surface 310 does not include any steps or cuts, such as for example steps 318, 320 and 322, the release 10 will not emit any signals, as described hereinabove, before the bowstring is released. Therefore, for at least this reason, there are no indentations and/or markings and such on the surface 356 of the lobe 302.

It will be appreciated that the signal emitted by the release 10 when the jaw 200 drops or falls from one surface of a lobe to the other, as described in the foregoing, does not necessarily have to be an audible signal. In some embodiments, the emitted signal can be a tactile signal that would be felt by the user through the hand holding the release 10. In certain embodiments, the emitted signal can be an electrical signal that could be used for energizing a buzzer or a light source. In some embodiments, the electrical signal could be from a piezo-electric source. In certain embodiments, the emitted signal can be a combination of any two or more of an audible signal, a tactile signal and an electrical signal. It should be clearly understood that there is no intent, implied or otherwise, to limit the type or form of the emitted signal to those disclosed herein. All alternate forms, sources, etc., for emitting a signal are considered as being within the metes and bounds of the instant disclosure.

Figure 7:
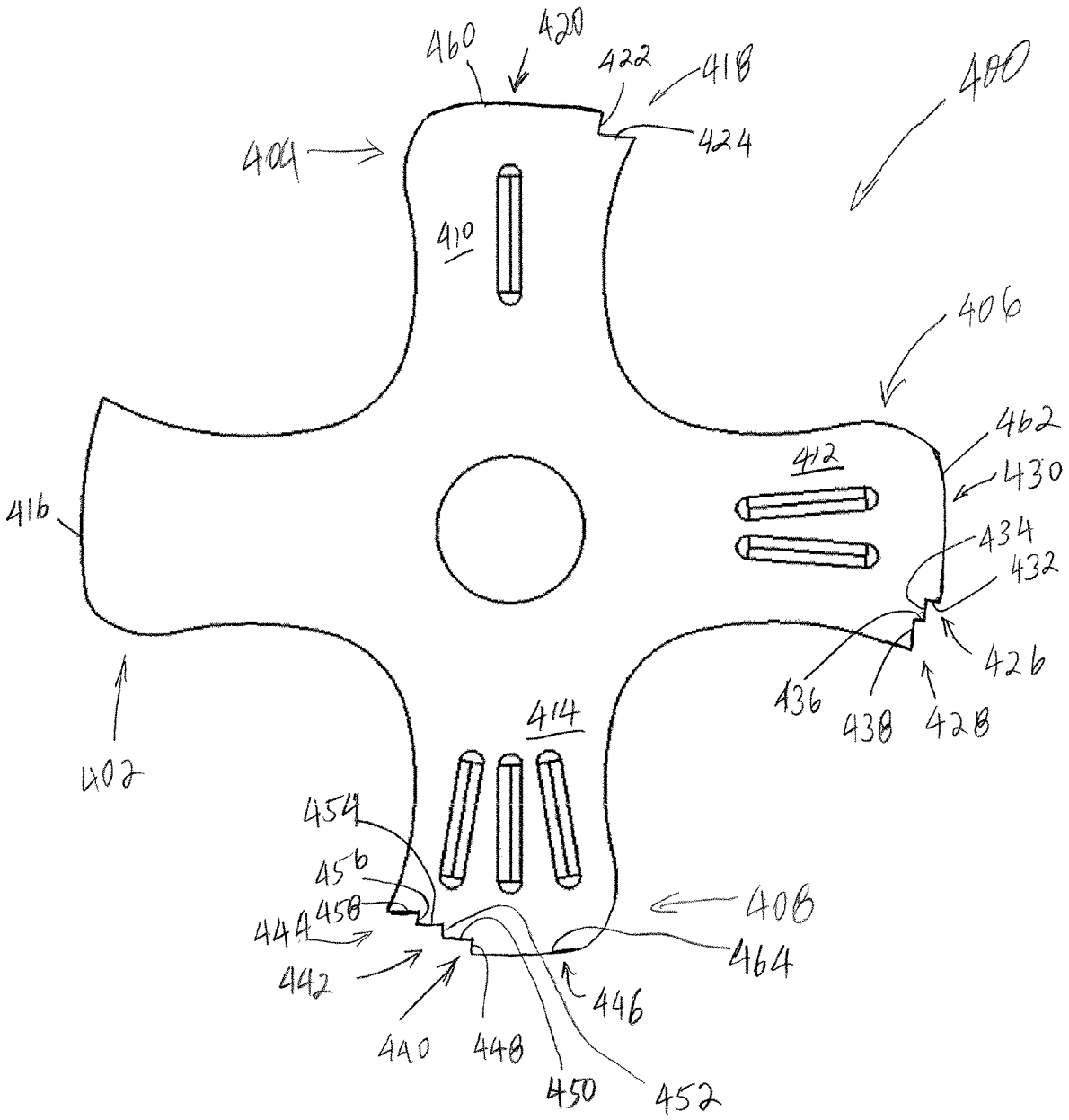
FIG. 7 is an elevational view of another non-limiting exemplary embodiment of a sear of the instant disclosure.

FIG. 7 illustrates another non-limiting exemplary embodiment of a sear 400 for the release 10 as an alternative to the sear 300. In the illustrated embodiment, the sear 400 is configured with four lobes 402, 404, 406 and 408 that define four different settings for emitting the signals that notify the user that the release 10 is about to release the bowstring. In contrast to the sear 300, in some embodiments of the sear 400, the indentations or markings "I", "I I" and "I I I", respectively, on the surfaces 410, 412 and 414 of respective lobes 404, 406 and 408 represent or correspond to the number of signals that will be emitted by the release 10 before the bowstring is released. It will be appreciated that, at least in the illustrated embodiment of sear 400, the number of signals that will be emitted by the release 10 before the bowstring is released corresponds to or equals the number of "steps" or "cuts" in the surfaces 410, 412 and 414.

The lobe 402, which does not have any indentations or markings on its surface 416, is structurally and operationally substantially similar to the lobe 302 of the sear 300. And, the lobe 404, which has the indentation or marking "I" on its surface 410 representing one step or cut 418 on its surface 420, is structurally and operationally substantially similar to the lobe 304 of the sear 300. The step 418 is defined by a height (e.g., riser height) 422 and a length (or distance, e.g., tread run) 424. The indentation or marking "I I" on the surface 412 of the lobe 406 represents or corresponds to the two steps or cuts 426 and 428 on the surface 430 of the lobe 406. The step 426 is defined by height 432 and length 434, and the step 426 is defined by height 436 and length 438. The indentation or marking "I I I" on the surface 414 of the lobe 408 represents or corresponds to the three steps or cuts 440, 442 and 444 on the surface 446 of the lobe 408. The step 440 is defined by height 448 and length 450; the step 442 is defined by height 452 and length 454; and the step 444 is defined by height 456 and length 458. In some embodiments, some or all heights 422, 432, 436, 448, 452 and 456 may be equal to one another. In certain embodiments, some or all heights 422, 432, 436, 448, 452 and 456 may be unequal from one another. In some embodiments, some or all lengths 424, 434, 438, 450, 454 and 458 may be equal to one another. In certain embodiments, some or all lengths 424, 434, 438, 450, 454 and 458 may be unequal from one another.

When the release 10 equipped with the sear 400 draws on a bowstring, at least the portion 204 of the jaw 200 slidingly engages or couples with at least a portion of one of the surfaces 416, 460, 462 and 464 corresponding to the setting, i.e., the lobe, selected by the user. As the user rotates the release 10 with the bowstring drawn, the portion 204 of the jaw 200 will slide along the surface it is coupled with until it slides off the selected lobe. Each time the jaw 200 drops or falls over a step, the release 10 will emit a signal informing the user that continued rotation of the release 10 will release the bowstring after the jaw 200 has traveled the length of the last step it dropped off of. Accordingly, if the setting "I" is selected, the release 10 will emit one signal when the jaw 200 falls over the step 418, and the bowstring will be released after the jaw 200 has traveled the length 424. Likewise, if the setting "I I" is selected, the release 10 will emit two signals as the jaw 200 falls over the two steps 426 and 428, and the bowstring will be released after the jaw 200 has traveled the length 438 of the last step 428. Similarly, if the setting "I I I" is selected, the release 10 will emit three signals as the jaw 200 falls over the three steps 440, 442 and 444, and the bowstring will be released after the jaw 200 has traveled the length 458 of the last step 444. And, if the user selects lobe 402, then the release 10 will not emit any signals and the drawn bowstring will be released when the jaw 200 slides off the surface 416.

Each time the jaw 200 falls over a step of the sear 400, it will impact the "tread" of the step it fell over and emit a signal. As previously described, the emitted signal may be any one or more of an audible signal, a tactile signal, and an electrical signal. In some embodiments, the signal emitted by the release 10 will be different each time the jaw 200 falls over a step of a lobe having two or more steps. For instance, if the setting "I I" is selected, the signal emitted by the release 10 when the jaw 200 falls over the step 426 may be different from the signal emitted when the jaw 200 falls over the step 428. Likewise, if the setting "I I I" is selected, each signal emitted by the release 10 when the jaw 200 falls over each step 440, 442 and 44 may be different from one another. In some embodiments, two consecutively emitted signals may be different from each other, but the third signal may be the same as the first.

It should be well understood that there is no intent, implied or otherwise, to limit the number of lobes and/or the number of steps associated with each lobe to only the embodiments illustrated and described herein. In some embodiments, the sear may have less than four lobes. In certain embodiments, the sear may have more than four lobes. In some embodiments, a lobe may have more than three steps. In certain embodiments, more than one lobe may have no steps. In some embodiments, all lobes may have at least one step each. Any and all variant are considered to be within the metes and bounds of the instant disclosure.

It should also be well understood that the instant disclosure is not limited, implied or otherwise, to the structural and/or operational features described herein with reference to the sears 300 and 400. Embodiments of one or more sears having any combination of one or more structural and/or operational features selected from the embodiments of sears 300 and 400 disclosed herein, or as may be contemplated by one skilled in the art are considered as being within the metes and bounds of the instant disclosure.

Figure 8A:
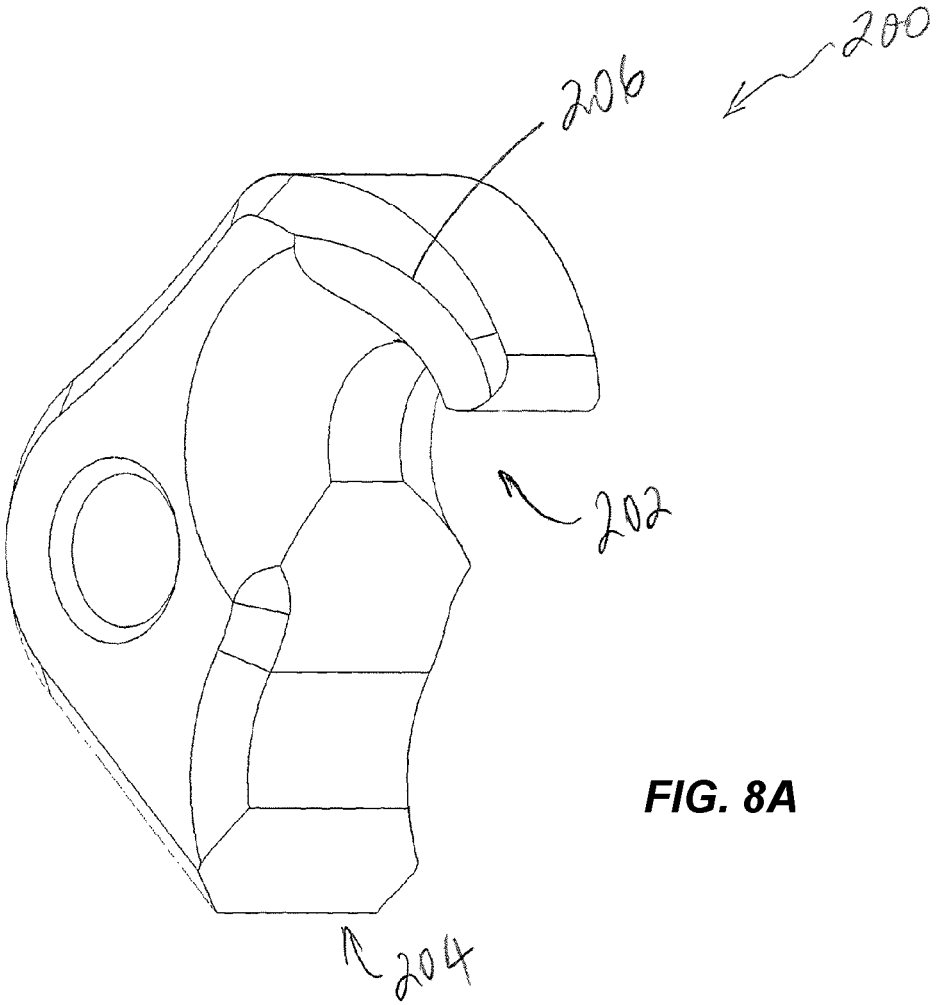
FIG. 8A is a perspective view of a non-limiting exemplary embodiment of a jaw in accordance with the instant disclosure.
Figure 8B:
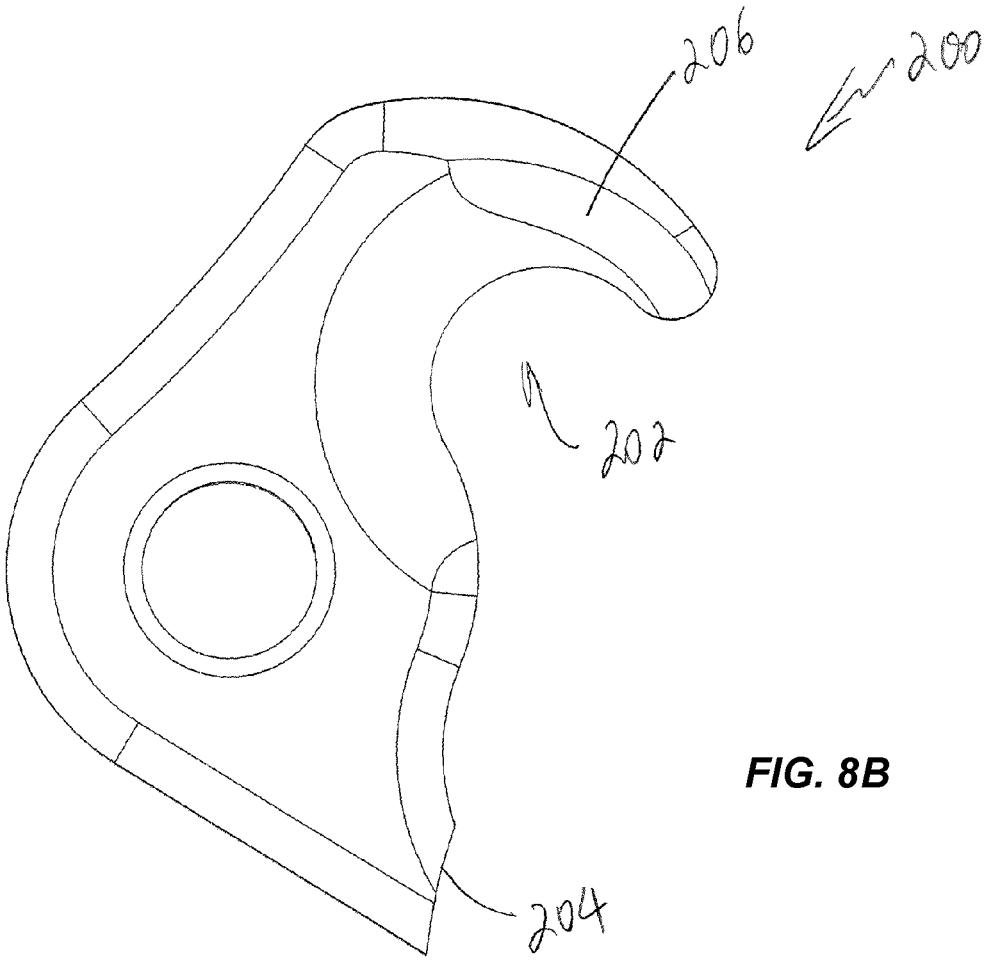
FIG. 8B is a side view of the jaw of FIG. 8A.
Figure 8C:
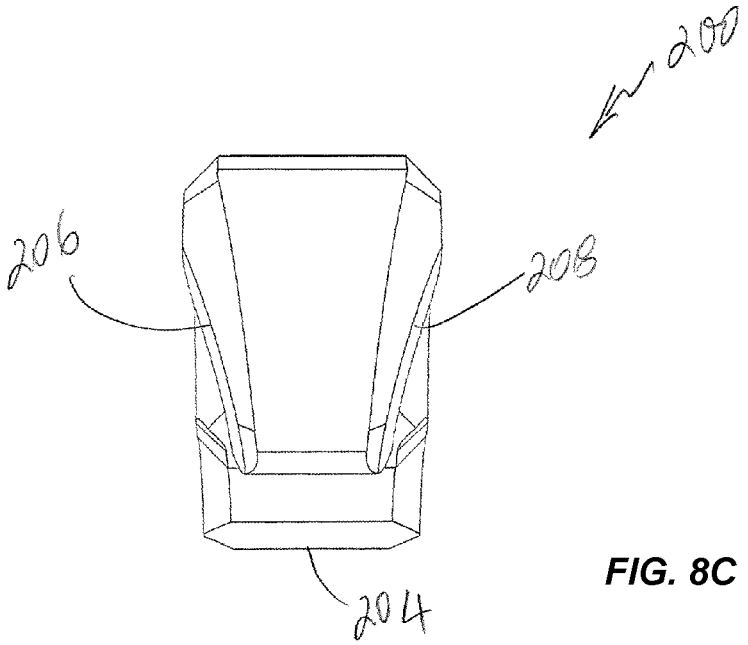
FIG. 8C is a front view of the jaw of FIG. 8A.

FIGS. 8A-8C, respectively, are a perspective view, a side view and a front view of the jaw 200 in accordance with a non-limiting exemplary embodiment of the instant disclosure. As previously described, the jaw 200 includes a hook-like structure 202 for engaging or retaining the bowstring. In some embodiments, the hook-like structure 202 is configured for retaining the bowstring irrespective of whether or not the bowstring is drawn. Also as previously described, the jaw 200 includes a portion 204 that slidingly engages or couples with a surface of any one of the lobes of the sears 300 and 400 when the bowstring is drawn. In a non-limiting exemplary embodiment, the hook 202 includes one or more contours or arcuate surfaces 206 and 208 configured for a smooth release of the bowstring held within the hook 202. In some embodiments, the surfaces 206 and 208 are contiguous with there being no sharp portion at the mouth of the hook-like structure 202. As the user rotates the release 10 clockwise or counter-clockwise, one of the contours 206 and 208 provide a smooth transitioned surface for the bowstring to slide along prior to being released.

Figure 9:
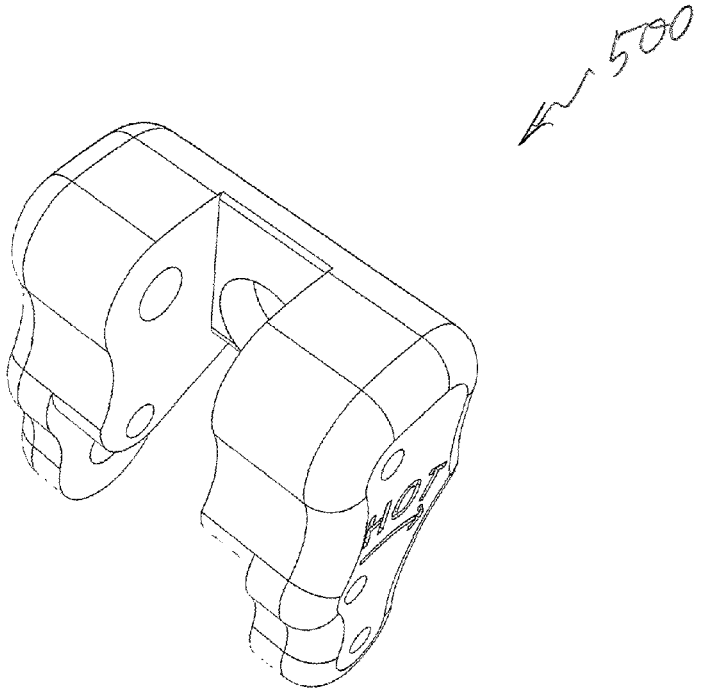
FIG. 9 is a perspective view of a jaw housing.

In a non-limiting exemplary embodiment of the release 10, the pitch angle of the jaw 200, and consequently the pitch angle of the release 10, relative to a longitudinal axis of an arrow (not shown) attached to the bowstring is adjustable. In some embodiments, such adjustments of the pitch angle is enabled by a jaw housing 500 coupling the jaw 200 to the handle 100. A non-limiting exemplary embodiment of a jaw housing 500 is illustrated in FIG. 9.

In a non-limiting exemplary embodiment, the release 10 includes an adjustable "thumb rest" or "thumb post" 102 on which the user may place his/her thumb while using the release 10. In some embodiments, the thumb rest 102 can be relocated to any one of the locations 104 and 106.

In a non-limiting exemplary embodiment, the handle 100 of the release 10 is configured as a "three finger" release. As illustrated in FIGS. 1-4, the handle 100 includes three contoured surfaces 108, 110 and 112 for respectively accommodating a user's index finger, middle finger, and ring finger. As can be seen, the handle 100, in general, does not include a section for accommodating the user's little (or "pinky") finger. As such, the user's little (or pinky) finger is not used for holding the release 10. In some embodiments, the section 114 of the handle 100 is replaceable so that the handle can be re-configured for accommodating more than three fingers.

Figure 10:
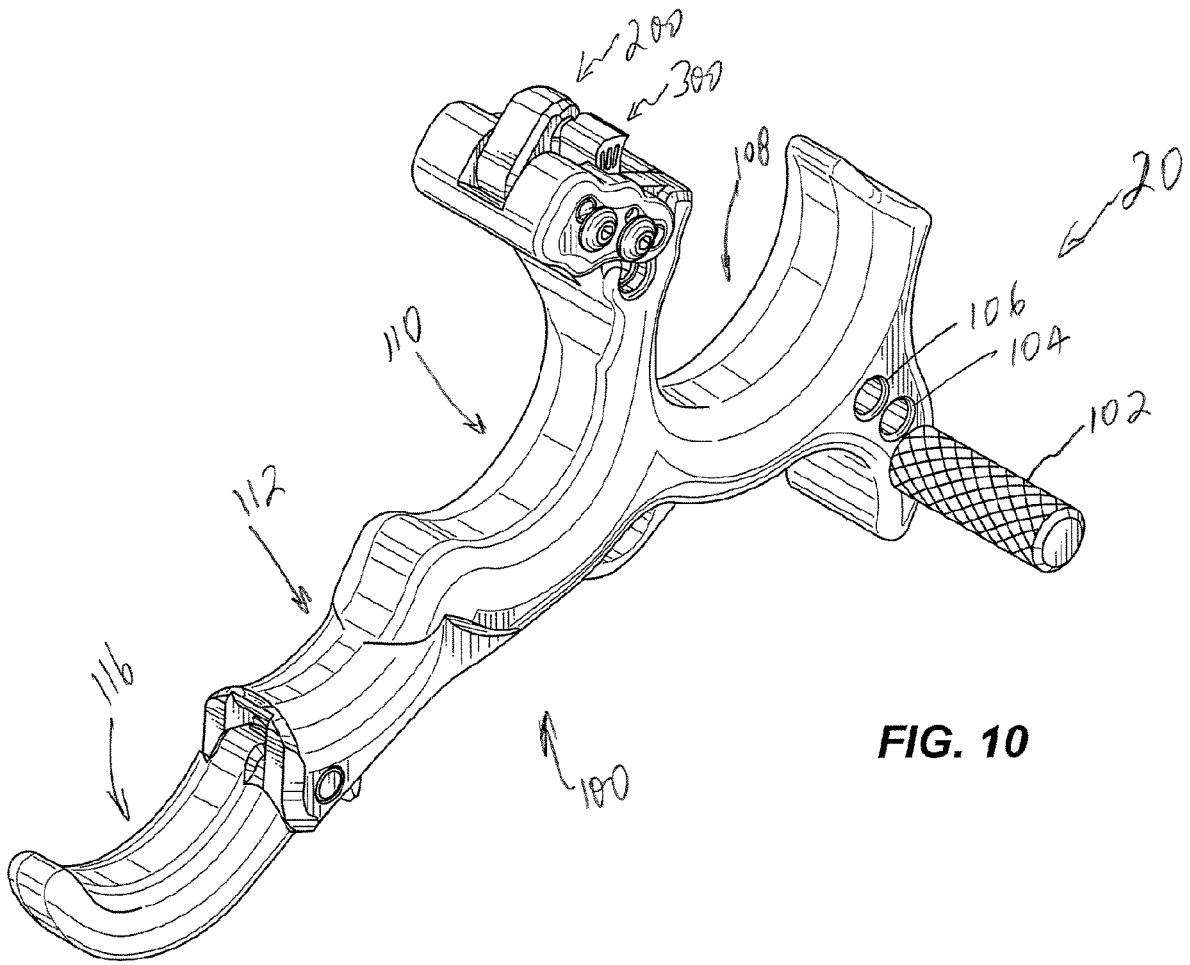
FIG. 10 is a perspective view of another non-limiting exemplary embodiment of a bowstring release of the instant disclosure.

FIG. 10 is a perspective view of a non-limiting exemplary embodiment of a four-finger release 20. In some embodiments, the handle 100 of the release 20 is substantially similar to the handle 100 of the release 10. One difference between the releases 10 and 20 is that the section 114 of the handle 100 of the release 10 has been replaced with the section 116 whereby the release 20 becomes a four-finger release that can be held by the users index finger, middle finger, ring finger, and little (or "pinky") finger. In some embodiments, the orientation of the section 116 relative to the handle 100 is adjustable. In several other aspects, the releases 10 and 20 are substantially similar to each other.

In view thereof, modified and/or alternate configurations of the embodiments described herein may become apparent or obvious to one of ordinary skill. All such variations are considered as being within the metes and bounds of the instant disclosure. For instance, while reference may have been made to particular feature(s) and/or function(s), the disclosure is considered to also include embodiments configured for functioning and/or providing functionalities similar to those disclosed herein with reference to the accompanying drawings. Accordingly, the spirit, scope and intent of the instant disclosure is to embrace all such variations. Consequently, the metes and bounds of the disclosure is solely defined by the appended claims and any and all equivalents thereof.

What is claimed is:

1. A bowstring release, comprising:

a handle;

a jaw coupled to the handle, wherein the jaw is configured for drawing the bowstring; and releasing the bowstring; and a sear coupled to the handle, the sear comprising a plurality of lobes, wherein each lobe defines a discrete setting indicative of an amount the release must be rotated for releasing the bowstring.

2. The release of claim 1, wherein at least a portion of the jaw is slidingly coupled to at least a portion of a surface of one of the plurality of lobes.

3. The release of claim 2, wherein rotating the release with the bowstring drawn causes the jaw to slide along the surface of the lobe.

4. The release of claim 3, wherein the jaw and the sear de-couple when the jaw slides off the surface of the lobe.

5. The release of claim 4, wherein the bowstring is released when the jaw and the sear decouple.

6. The release of claim 5, configured for emitting a signal before the bowstring is released.

7. The release of claim 6, wherein the signal is audible or tactile or electrical or a combination of two or more thereof.

8. The release of claim 6, wherein the signal corresponds to the setting of the lobe.

9. The release of claim 8, wherein setting indicates the amount the release must be rotated after emitting the signal and before releasing the bowstring.

10. The release of claim 9, wherein the amount the release must be rotated increases between successive lobes.

11. The release of claim 9, wherein the amount the release must be rotated decreases between successive lobes.

12. The release of claim 5, configured for emitting one or more signals before the bowstring is released.

13. The release of claim 12, wherein the number of signals is defined by each lobe.

14. The release of claim 13, wherein the amount the release must be rotated after emitting the last signal and before releasing the bowstring is the same for each of the plurality of lobes.

15. The release of claim 13, wherein the amount the release must be rotated after emitting the last signal and before releasing the bowstring increases between successive lobes.

16. The release of claim 13, wherein the amount the release must be rotated after emitting the last signal and before releasing the bowstring decreases between successive lobes.

17. The release of claim 3, wherein the jaw is inhibited from releasing the bowstring while the jaw and the lobe are coupled.

18. The release of claim 1, configured for minimizing bowstring release anticipation.

19. The release of claim 1, configured as a back-tension release.

20. The release of claim 1, comprising a jaw housing for coupling the handle and the jaw to each other.

21. The release of claim 1, comprising a thumb post.

22. The release of claim 21, comprising a plurality of locations whereat the thumb post can be re-located.

23. The release of claim 1, configured for being held with a plurality of fingers.

24. The release of claim 23, comprising an attachment for a user's little finger.

25. The release of claim 24, wherein a sweep angle of the attachment is adjustable.

26. The release of claim 1, wherein a pitch angle of the jaw relative to a longitudinal axis of an arrow attached to the bowstring is adjustable.

27. A bowstring release, comprising:

a handle;

a jaw coupled to the handle, wherein the jaw is configured for drawing the bowstring; and releasing the bowstring; and a sear coupled to the handle, the sear comprising a plurality of lobes, wherein each lobe is configured to define an amount the release must be rotated for releasing the bowstring.

28. The release of claim 27, wherein each lobe comprises a discrete setting defining the amount of rotation.

* * * * *